US010637166B1

(12) United States Patent
Kranz et al.

(10) Patent No.: US 10,637,166 B1
(45) Date of Patent: Apr. 28, 2020

(54) MODULAR CONDUCTOR CONNECTOR ASSEMBLIES AND CONNECTING METHODS

(71) Applicant: AFL Telecommunications LLC, Duncan, SC (US)

(72) Inventors: Steven E. Kranz, Moore, SC (US); Matthew G. Wellborn, Greenville, SC (US); Wayne L. Quesnel, Moore, SC (US)

(73) Assignee: AFL Telecommunications LLC, Duncan, SC (US)

( * ) Notice: Subject to any disclaimer, the term of this patent is extended or adjusted under 35 U.S.C. 154(b) by 0 days.

(21) Appl. No.: 16/156,668

(22) Filed: Oct. 10, 2018

(51) Int. Cl.

| | |
|---|---|
| ***H01R 11/12*** | (2006.01) |
| ***H01R 4/56*** | (2006.01) |
| ***H01R 4/18*** | (2006.01) |
| ***H01R 43/04*** | (2006.01) |
| *H01R 4/30* | (2006.01) |
| *H01R 43/048* | (2006.01) |

(Continued)

(52) U.S. Cl.
CPC ..... *H01R 4/56* (2013.01); *H01R 4/183* (2013.01); *H01R 11/12* (2013.01); *H01R 43/04* (2013.01); *H01R 4/185* (2013.01); *H01R 4/188* (2013.01); *H01R 4/20* (2013.01); *H01R 4/203* (2013.01); *H01R 4/307* (2013.01); *H01R 11/26* (2013.01); *H01R 43/048* (2013.01)

(58) Field of Classification Search
CPC ..... H01R 4/185; H01R 4/188; H01R 43/048; H01R 4/203; H01R 11/12; H01R 11/26; H01R 4/20; H01R 4/307
USPC ..... 439/877, 882, 868, 883
See application file for complete search history.

(56) References Cited

U.S. PATENT DOCUMENTS 3,065,438 A * 11/1962 Anderson ..... H01R 4/56 439/194
4,367,001 A * 1/1983 Munakata ..... H01R 24/58 439/175

(Continued)

OTHER PUBLICATIONS

AFL Standard Compression Catalogue https://www.aflglobal.com/productionFiles/resources/catalogs/Transmission-and-Distribution/Standard-Compression-Catalog.aspx (Year: 2004).*

(Continued)

*Primary Examiner* — Abdullah A Riyami
*Assistant Examiner* — Justin M Kratt
(74) *Attorney, Agent, or Firm* — Dority & Manning, P.A.

(57) ABSTRACT

Conductor connector assemblies and methods for connecting conductors and conductor connector assemblies are provided. An assembly includes a base attachment accessory extending between a first end and a second end. The base attachment accessory further defines a bore hole extending therein from the second end. The base attachment accessory further includes an internal thread in the bore hole. The assembly further includes a barrel assembly connectable to the base attachment accessory. The barrel assembly includes a barrel extending between a first end and a second end. The barrel assembly further includes a rod extending from the first end of the barrel and an external thread on the rod. The external thread is mateable with the internal thread. The barrel assembly further defines a conductor passage extending into the barrel from the second end thereof. The barrel is radially compressible.

22 Claims, 5 Drawing Sheets

(51) Int. Cl.
*H01R 11/26* (2006.01)
*H01R 4/20* (2006.01)

(56) References Cited

U.S. PATENT DOCUMENTS

| | | | | | |
|---|---|---|---|---|---|
| 4,944,686 | A * | 7/1990 | Gertz | H01R 4/5033 | 439/175 |
| 5,791,919 | A * | 8/1998 | Brisson | H01R 27/00 | 439/166 |
| 6,129,568 | A * | 10/2000 | Mercurio | H01R 11/12 | 439/166 |
| 6,176,716 | B1 * | 1/2001 | Mercurio | H01R 11/12 | 439/166 |
| 6,319,078 | B1 * | 11/2001 | Thorner | H01R 11/12 | 439/883 |
| 2007/0062718 | A1 * | 3/2007 | De France | H01R 4/5025 | 174/84 C |
| 2010/0206631 | A1 * | 8/2010 | Peters | H01R 4/203 | 174/77 R |

OTHER PUBLICATIONS

Ny-G Hydraulic Compression Anchor Forged Strain Clamp for Grounding Wire https://cnhaiwe.en.made-in-china.com/product/RvsEuaDVvGUi/ China-Ny-G-Hydraulic-Compression-Anchor-Forged-Strain-Clamp-for-Grounding-Wire.html (Year: 2019).*

* cited by examiner

MODULAR CONDUCTOR CONNECTOR ASSEMBLIES AND CONNECTING METHODS

FIELD

The present disclosure relates generally to conductor connector assemblies which include attachment accessories such as dead ends, and to methods for connecting conductors to such conductor connector assemblies.

BACKGROUND

Conductors are utilized in a variety of environments for carrying electrical current and generally facilitating the transmission of electricity. Conductor attachment accessories are utilized to connect the conductors to other conductors or to other components of the energy transmission assembly such as other conductor connector accessories or the tower. Examples of conductor attachment accessories include dead ends, splices, terminals, repair sleeves, t-taps, t-connectors, jumper connectors, etc.

In many cases, the conductors are installed in relatively high tension. Due to the relatively high tension environments, it is desirable for the connection between a conductor connector accessory and conductor to be robust, thereby preventing relative movement between the conductor and attachment accessory and/or disconnection of the conductor from the attachment accessory.

Typically, compressive forces are utilized to connect conductors to attachment accessories. However, there are disadvantages to some currently known attachment accessories. For example, the length of the attachment accessory which is available for compression can be limited. Additionally, many attachment accessories are forged, and new forgings for new applications require custom tooling. This can be time consuming and expensive.

Accordingly, improvements to conductor attachment accessories and methods for connecting conductor attachment accessories and conductors together are desired. In particular, accessories and methods which can be utilized in a variety of environments and with a variety of different types of conductors, in an efficient and inexpensive manner, would be advantageous.

BRIEF DESCRIPTION

Aspects and advantages of the invention will be set forth in part in the following description, or may be obvious from the description, or may be learned through practice of the invention.

In accordance with one embodiment, a conductor connector assembly is provided. The assembly includes a base attachment accessory extending between a first end and a second end. The base attachment accessory further defines a bore hole extending therein from the second end. The base attachment accessory further includes an internal thread in the bore hole. The assembly further includes a barrel assembly connectable to the base attachment accessory. The barrel assembly includes a barrel extending between a first end and a second end. The barrel assembly further includes a rod extending from the first end of the barrel and an external thread on the rod. The external thread is mateable with the internal thread. The barrel assembly further defines a conductor passage extending into the barrel from the second end thereof. The barrel is radially compressible.

In accordance with another embodiment, a method for connecting a conductor and a conductor connector assembly is provided. The method includes selecting a barrel assembly from a plurality of available barrel assemblies. The barrel assembly includes a barrel extending between a first end and a second end. The barrel assembly further includes a rod extending from the first end of the barrel and an external thread on the rod. The barrel assembly further defines a conductor passage extending into the barrel from the second end thereof. The method further includes connecting the selected barrel assembly to a base attachment accessory. The base attachment accessory extends between a first end and a second end. The base attachment accessory further defines a bore hole extending therein from the second end. The base attachment accessory further includes an internal thread in the bore hole. Connecting the selected barrel assembly to the base attachment accessory includes threadably mating the rod into the bore hole. The method further includes inserting an end portion of the conductor into the conductor passage. The method further includes radially compressing the barrel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE FIGURES

A full and enabling disclosure of the present invention, including the best mode thereof, directed to one of ordinary skill in the art, is set forth in the specification, which makes reference to the appended figures, in which.

DETAILED DESCRIPTION

Figure 1:
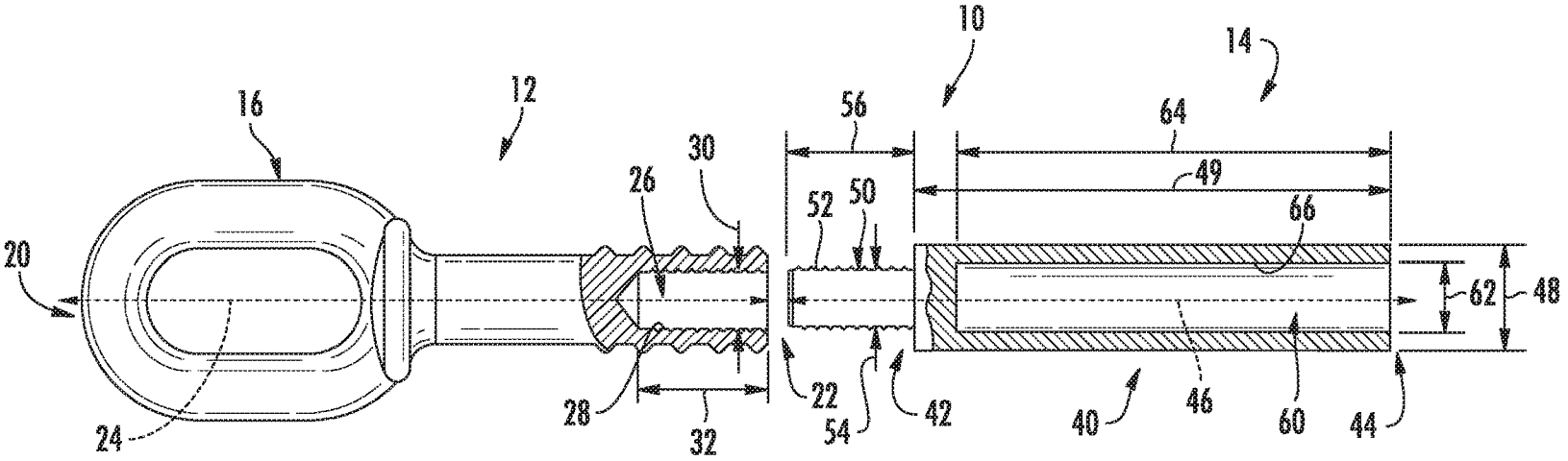
FIG. 1 is a cross-sectional view of a conductor connector assembly, with a base attachment accessory and barrel assembly thereof in unconnected positions, in accordance with embodiments of the present disclosure.
Figure 2:
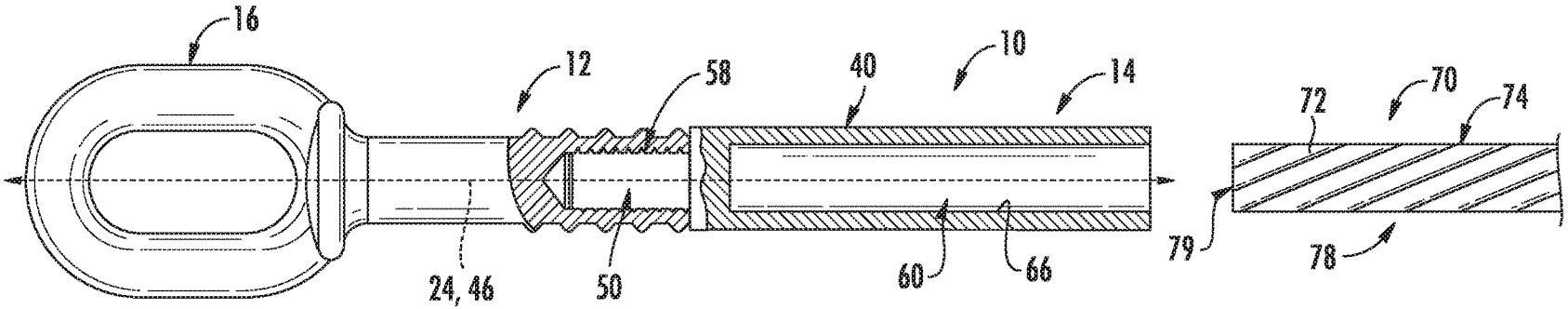
FIG. 2 is a cross-sectional view of a conductor connector assembly, with a base attachment accessory and barrel assembly thereof in connected positions, in accordance with embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction.

Referring now generally to FIGS. 1 through 8, embodiments of conductor connector assemblies and methods for connecting conductors with such conductor connector assemblies in accordance with the present disclosure are provided. Conductor connector assemblies in accordance with the present disclosure are advantageously modular and generally include two main components, a base attachment accessory and a barrel assembly connectable thereto. The base attachment accessory may generally include certain features of conventional attachment accessories. However, the base attachment accessory may further be connectable to the barrel assembly, such as via a threaded bore defined in the base attachment accessory. The barrel assembly may be connectable to the base attachment accessory, include a radially compressible barrel. In exemplary embodiment, the barrel assembly is selected from a group of barrel assemblies, each of which has at least one different characteristic, such as barrel outer diameter or axial length, from the other barrel assemblies in the group. Accordingly, a desired barrel assembly can be selected based on the conductor being utilized, the compressive requirements of the application, and other necessary factors. Use of conductor connector assemblies and associate methods is thus efficient and cost-effective while providing desire conductor connection features.

In exemplary embodiments, conductor connector assemblies in accordance with the present disclosure are utilized with aluminum conductor composite reinforced ("ACCR") conductors, aluminum conductor composite core ("ACCC"), or aluminum conductor steel supported ("ACSS") conductors. Alternatively, however, any suitable conductors may be utilized. Other suitable conductors may include, for example, aluminum conductor composite supported ("ACCS") conductors, aluminum conductor steel reinforced ("ACSR") conductors, alumoweld ("AW") conductors, steel ground wire, etc. Conductors having single member cores, or multiple member cores (such as stranded cores) may be utilized. The core materials and outer layer materials may be the same, or may be different. Examples of suitable accessories which the base attachment accessory may include features of include, for example, dead ends, splices, terminals, repair sleeves, t-taps, t-connectors, jumper connectors, and other suitable attachment accessories for attaching conductors to other conductors or to other components of an energy transmission assembly such as other conductor attachment accessories or a tower.

Figure 3:
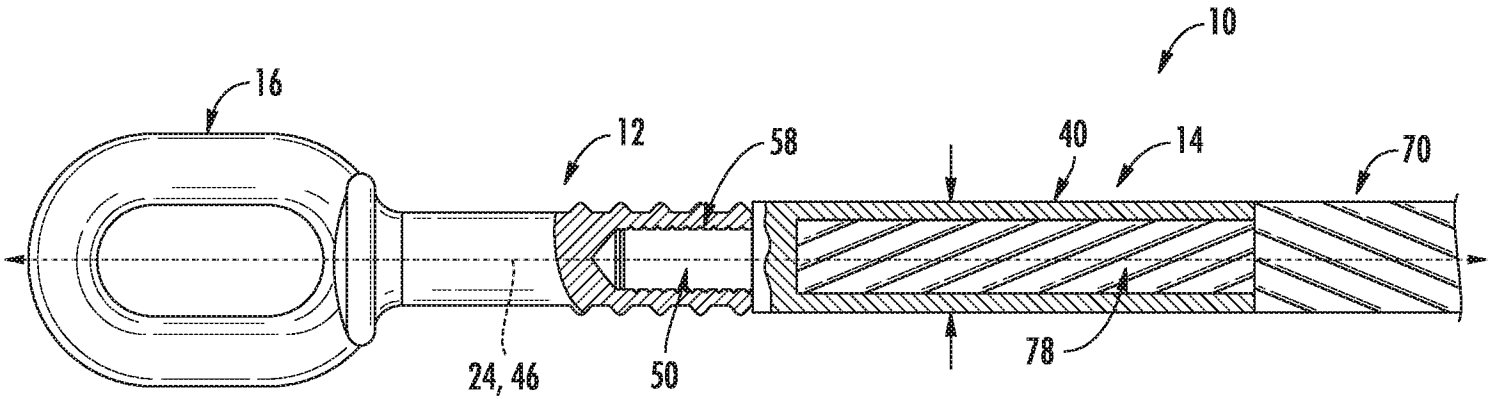
FIG. 3 is a cross-sectional view of a conductor connector assembly, with an end portion of a conductor inserted into the conductor connector assembly, in accordance with embodiments of the present disclosure.
Figure 4:
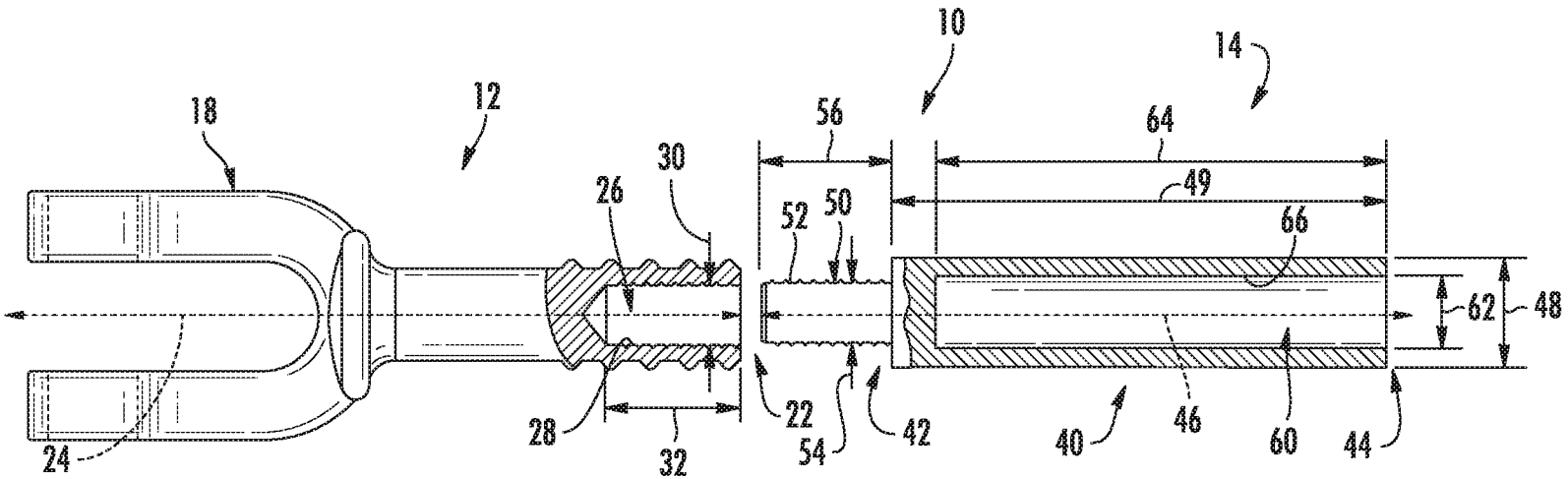
FIG. 4 is a cross-sectional view of a conductor connector assembly, with a base attachment accessory and barrel assembly thereof in unconnected positions, in accordance with other embodiments of the present disclosure.

Referring now to FIGS. 1 through 4, embodiments of conductor connector assemblies 10. Assembly 10 may include a base attachment accessory 12 and a barrel assembly 14. In the embodiments shown, the base attachment accessory is a dead end. For example, in FIGS. 1 through 3, the base attachment accessory 12 includes an eye 16. In FIG. 4, the base attachment accessory 12 includes a clevis 18.

Base attachment accessory 12 may extend between a first end 20 and a second end 22, such as along a longitudinal axis 24. Attachment features of the base attachment accessory 12, such as the eye 16 or clevis 18 in the case of a dead end as shown, may be positioned at the first end 20 of the accessory 12. Further, a bore hole 26 may be defined in the accessory 12. Bore hole 26 may extend into the accessory 12 from the second end 22, such as along the longitudinal axis 24. Bore hole 26 may be tapped such that an internal thread 28 is formed in the bore hole 26, as shown. The bore hole 26 may have an outer diameter 30 (such as a nominal diameter) and an axial length 32, as shown.

In some exemplary embodiments, the base attachment accessory 12 may be formed from a steel. Alternatively, other suitable materials, such as aluminum, titanium, etc., may be utilized.

In some exemplary embodiments, the base attachment accessory 12 may be a forged component. Alternatively, however, the base attachment accessory 12 may be cast, machine, rolled, or formed using another suitable manufacturing process. In exemplary embodiments, the base attachment accessory 12 is a single, unitary component.

Barrel assembly 14 may be connected to the base attachment accessory 12. Barrel assembly 14 may include, for example, a barrel 40 which extends between a first end 42 and a second end 44, such as along a longitudinal axis 46. Barrel may further have an outer diameter 48 and an axial length 49, as shown.

Barrel assembly 14 may further include a rod 50 which extends from the first end 42 of the barrel 40, such as along the longitudinal axis 46, away from the barrel 40. An external thread 52 may be provided on the rod 50. The rod 50 may have an outer diameter 54 (such as a nominal diameter) and an axial length 56, as shown. In exemplary embodiments, outer diameter 48 is greater than outer diameter 54. Further, in exemplary embodiments, axial length 56 is greater than axial length 49.

The external thread 52 may be mateable with the internal thread 28. Accordingly, the threads 52, 28 may have approximately the same lead, pitch, major diameter, minor diameter, pitch diameter, and/or other suitable characteristics. Further, the outer diameter 54 may be approximately equal to the outer diameter 30, and/or the axial length 56 may be approximately equal to the axial length 32.

A conductor passage 60 may be defined in the barrel 40. Conductor passage 60 may extend into the barrel 40 from the second end 44, such as along the longitudinal axis 46. The conductor passage 60 may have an outer diameter 62 and an axial length 64.

In some embodiments, a grit coating 66 may be applied to the interior surface defining the passage 60. The grit coating 66 may facilitate improved gripping of the barrel 40 on a conductor. The grit coating 66 may include a plurality of particles, such as in exemplary embodiments alumina, alundum, aloxite, borolon, and/or silicon carbide particles. The grit coating 66 may further include a varnish or other suitable adhesive in which the particles may be embedded, and which may provide a connection between the particles and the inner surface. When the end portion of a conductor is disposed within the conductor passage 60, the end portion may thus contact the grit coating.

The barrel 40 may be radially compressible, and thus the barrel assembly 14 may be formed from a compressible material. In exemplary embodiments, the barrel assembly 14 may be formed from a steel. Alternatively, other suitable materials, such as aluminum, titanium, etc., may be utilized.

In some exemplary embodiments, the barrel assembly 14 may be a forged component. Alternatively, however, the barrel assembly 14 may be cast, machine, rolled, or formed using another suitable manufacturing process. In exemplary embodiments, the barrel assembly 14 is a single, unitary component.

To connect together the base attachment accessory 12 and barrel assembly 14, the rod 50 may be threadably mated into the bore hole 26, such as by screwing the rod 50 into the bore hole 26 such that the threads 52, 28 mesh. When mated, the axes 24, 46 may be approximately parallel and, in exemplary embodiments, approximately coaxial. In some embodiments, an adhesive 58 may be applied to at least one of the threads 52 or threads 28, such as prior to such connection. The adhesive 58 may, during such connection, coat threads 52 and 28 and strengthen the bond of the rod 50 in the bore hole 26, thus strengthening the bond between the base attachment accessory 12 and the barrel assembly 14.

The barrel assembly 14 may advantageously be selected from a plurality of available barrel assemblies 14, such as prior to connection to the base attachment accessory 12. Each of the plurality of available barrel assemblies 14 may have at least one size characteristic for which the size is different from that of the characteristic of the selected barrel assembly 14. Such characteristic(s) may be one or more of outer diameter 48, axial length 49, outer diameter 62, and/or axial length 64.

Figure 5:
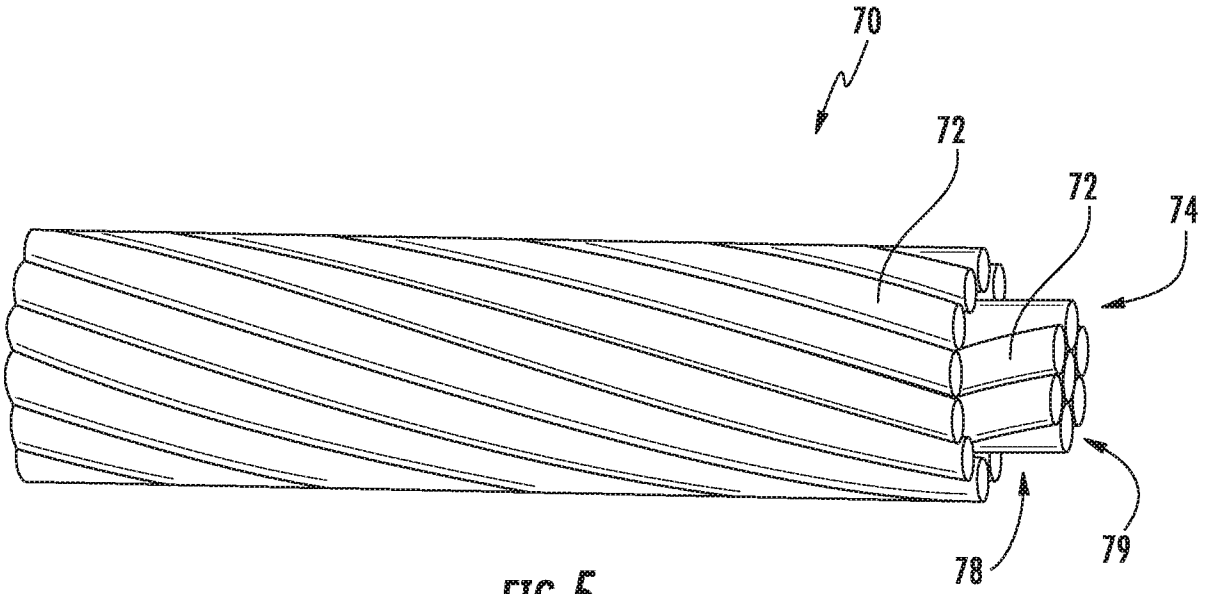
FIG. 5 is a side perspective view of a conductor in accordance with embodiments of the present disclosure.
Figure 6:
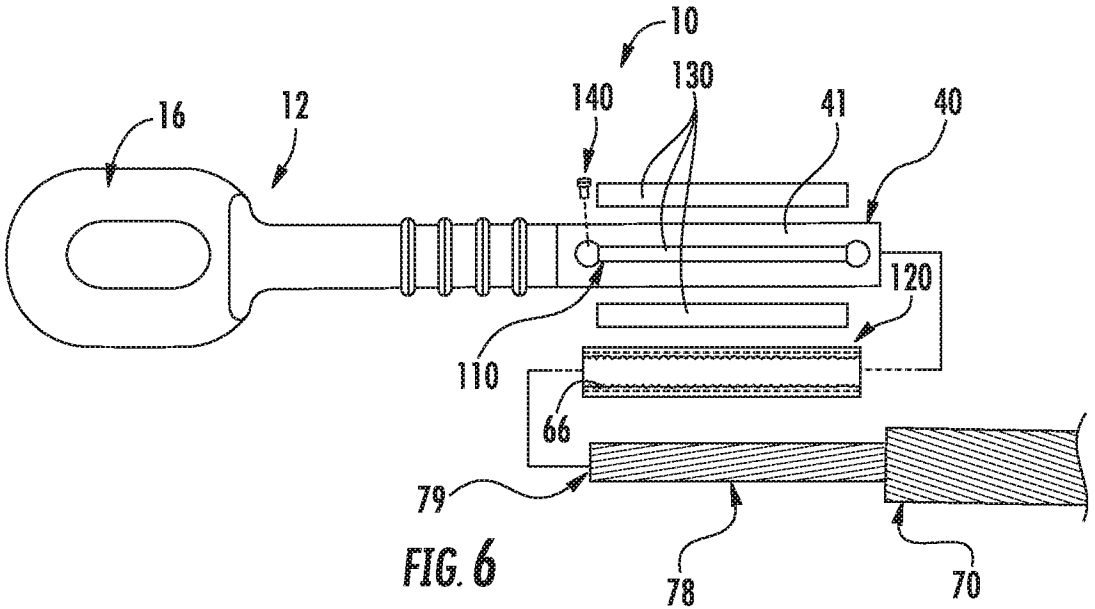
FIG. 6 is a cross-sectional view of a conductor connector assembly, with a base attachment accessory and barrel assembly thereof in connected positions and other components in exploded positions, in accordance with other embodiments of the present disclosure.

As discussed, conductor connector assemblies 10 in accordance with the present disclosure may be connected to conductors. Referring now to FIGS. 3, 5, and 6, conductors 70 in accordance with the present disclosure are provided. Any suitable conductors 70 may be connected to conductor connector assemblies 10 in accordance with the present disclosure.

A conductor 70 may, for example, include a plurality of conductor strands 72 which are arranged in one or more generally concentric layers. For example, in some embodiments as shown, a conductor 70 may include seven conductor strands 72 which form a core 74 of the conductor 70, with a central strand 72 surrounded by a layer of six strands 72. Core 74 may be a single member core which includes only a single strand 72 or a multiple member core (such as a stranded core) which utilizes multiple strands 72. One or more additional layers of strands may surround the core layers. The total number of strands in a conductor 70 may, for example, be 26, 45, 54, 84, etc. In some embodiments, the outer strands (outside the core) may have circular cross-sections, while in other embodiments the outer strands may have other suitable cross-sectional shapes such as trapezoids. One or more layers, such as the layer of six strands 72 surrounding the central strand 72, may have a helical arrangement, with each strand 72 extending helically about a longitudinal axis of the conductor 70.

In exemplary embodiments, the conductor strands 72 of conductor 70 are formed from one or more metals. For example, in some embodiments, each conductor strand 72 is formed from a steel and/or an aluminum. For example, in some embodiments as illustrated in FIGS. 3 and 5, each conductor strand 62 of the core 74 is formed from steel and each conductor strand 72 of the layer(s) surrounding the core 74 is formed from aluminum. The conductor strand(s) 72 of the core 74 may be formed from the same material as the strand(s) 72 of the outer layer(s), or may be formed from a different material from the strand(s) 72 of the outer layer(s). For example, the strand(s) 72 of the core 74 and/or the strand(s) of the outer layer(s) may be formed from steel, aluminum, aluminum fiber, aluminum reinforced with alumina fibers, carbon or glass fibers in a polymer matrix (such as an epoxy or a thermoplastic), or other suitable material(s).

The conductor passage 60 may be sized (including the outer diameter 62, and axial length 64) to accommodate an end portion 78 (which includes an end 79) of a conductor 70. During assembly, the end portion 78 may be inserted into the conductor passage 60 such that the barrel 40 surrounds the end portion 78. In exemplary embodiments, the end portion 78 includes only a portion of the core 74 of the conductor 70, as discussed herein, with outer layers of the conductor 70 having been cut back.

Figure 7:
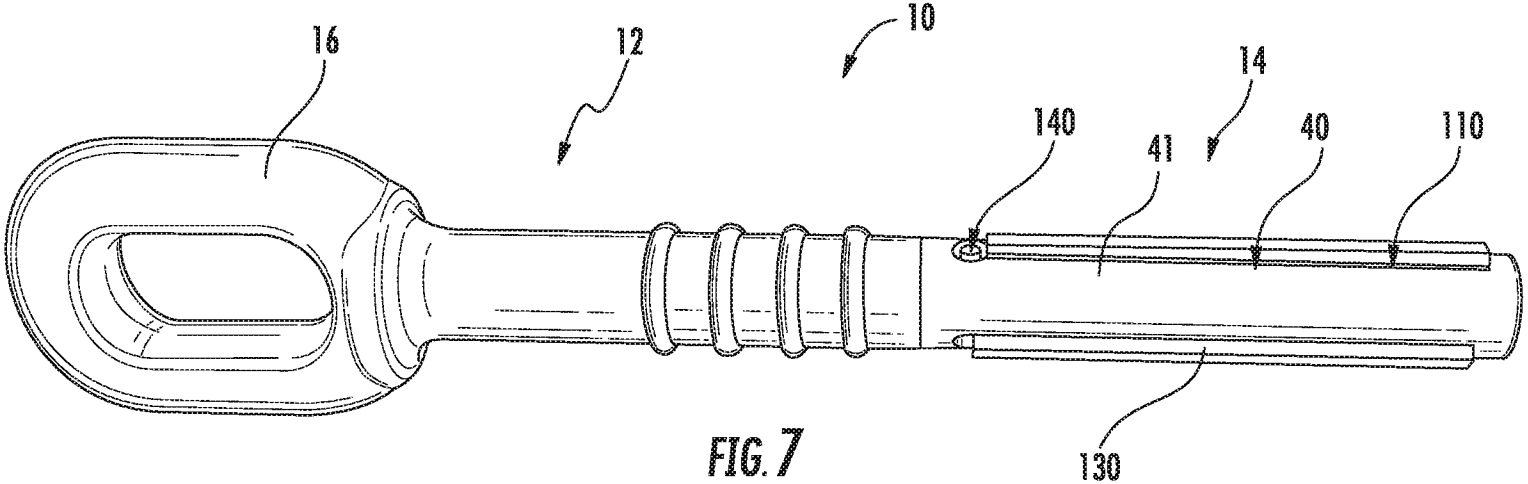
FIG. 7 is a perspective view of a conductor connector assembly, with a base attachment accessory and barrel assembly as well as other components thereof in connected positions, in accordance with other embodiments of the present disclosure.

Referring now to FIGS. 6 and 7, conductor connector assemblies 10 in accordance with the present disclosure may further include additional features which facilitate efficient and cost-effective connection to conductors 70 as discussed herein. For example, barrel 40 may include a plurality of radially extending passages 110 extending between the conductor passage 60 and an outer surface 41 of the barrel 40. The passages 110 may, for example, be disposed in one or more generally annular arrays about the conductor passage 60. In exemplary embodiments, three passages 110 may be defined in a single annular array. Alternatively, two, four or more passages 110 may be defined in a single annular array. Further, in some embodiments multiple annular arrays, such as two annular arrays, of passage 110 may be defined. A barrel 40 may be sized to accommodate within the conductor passage 60 a tube 120 (in which end portion 78 of conductor 70 is disposed, rather than being directly inserted into conductor passage 60 such that the end portion 78 is in direct contact with the barrel surface defining the conductor passage 60 as discussed above). During assembly, tubes 120 and associated end portions 68 may be inserted, such as fully inserted, into the conductor passage 60 such that the barrel 40 surrounds the tube(s) 120. In some embodiments, grit coating 66 may be applied to an inner surface defining the interior opening of the tube 120 in addition to or alternatively to being applied to the interior surface defining the passage 60.

A plurality of lobes 130 may additionally be provided. Each lobe 130 may be disposed within one of the plurality of passages 110, and may thus extend into the conductor passage 60. When assembled, i.e. when an associated tube 120 is disposed within the conductor passage 60 of a barrel 40, the lobes 130 may contact the tube 120 (i.e. an outer surface thereof). In exemplary embodiments, each lobe 130 may be formed from a material such as an aluminum, although in alternative embodiments other suitable materials such as other suitable metals may be utilized. In exemplary embodiments, the material from which the lobe 130 is formed is different from the material from which the barrel 40 (and barrel assembly 14) is formed.

In exemplary embodiments, each lobe 130 may have a wedge-shaped cross-sectional profile (i.e. when viewed in a front cross-sectional view). In exemplary embodiments, a wedge angle of between 5 degrees and 40 degrees, such as between 10 degrees and 30 degrees, such as between 15 degrees and 25 degrees, such as 20 degrees, may be defined for each lobe 130. Such wedge angles 39 are advantageous as they facilitate capture of the lobes 130 within the passages 110. In exemplary embodiments wherein the lobes 130 are formed from a material, such as aluminum, that is different from the material of the barrel 40, these materials may have different expansion rates. For example, the lobe material (such as aluminum) may expand faster than the barrel material (such as steel) at high temperatures as discussed herein. Because the lobes 130 are captured by virtue of the wedge angles, such expansion occurs generally radially inward, thus increasing the grip on the tube 120 and conductor 70 therein.

In some embodiments, one or more fasteners 140, such as rivets, self-tapping screws, pins, or other suitable mechanical fasteners, may be provided. Each fastener 140 may be inserted through one of the plurality of the passages 110 and into contact with a tube 120 inserted therein. In some embodiments, fastener 140 may merely contact an outer surface of the tube 120, while in other embodiments fastener 140 may extend into and/or through the tube 120 into the interior thereof. Fastener 140 may, by being partially positioned within a passage 110 and in contact with the tube 120, limit or prevent rotation of the tube 120 within the barrel 40 and prevent removal of the tube 120 from the barrel 40.

As discussed, tube 120 and lobes 130 may be formed from a material, which in exemplary embodiments may be an aluminum. Other components, such as the barrel 40 (and in some embodiments the barrel assembly 14) may be formed from a material that is different from the tube and lobe material, such as in exemplary embodiments a steel. Such difference in materials in such exemplary embodiments may advantageously allow the accessory to have improved performance in high temperature environments, such as in environments above 93 degrees Celsius and in some cases up to or above 250 degrees Celsius. For example, the second material, which in exemplary embodiments may be a steel, may act as a heat sink during operation. This advantageously reduces or prevents overheating of the other components during operation, thus resulting in improved performance of the assembly 10 generally.

Figure 8:
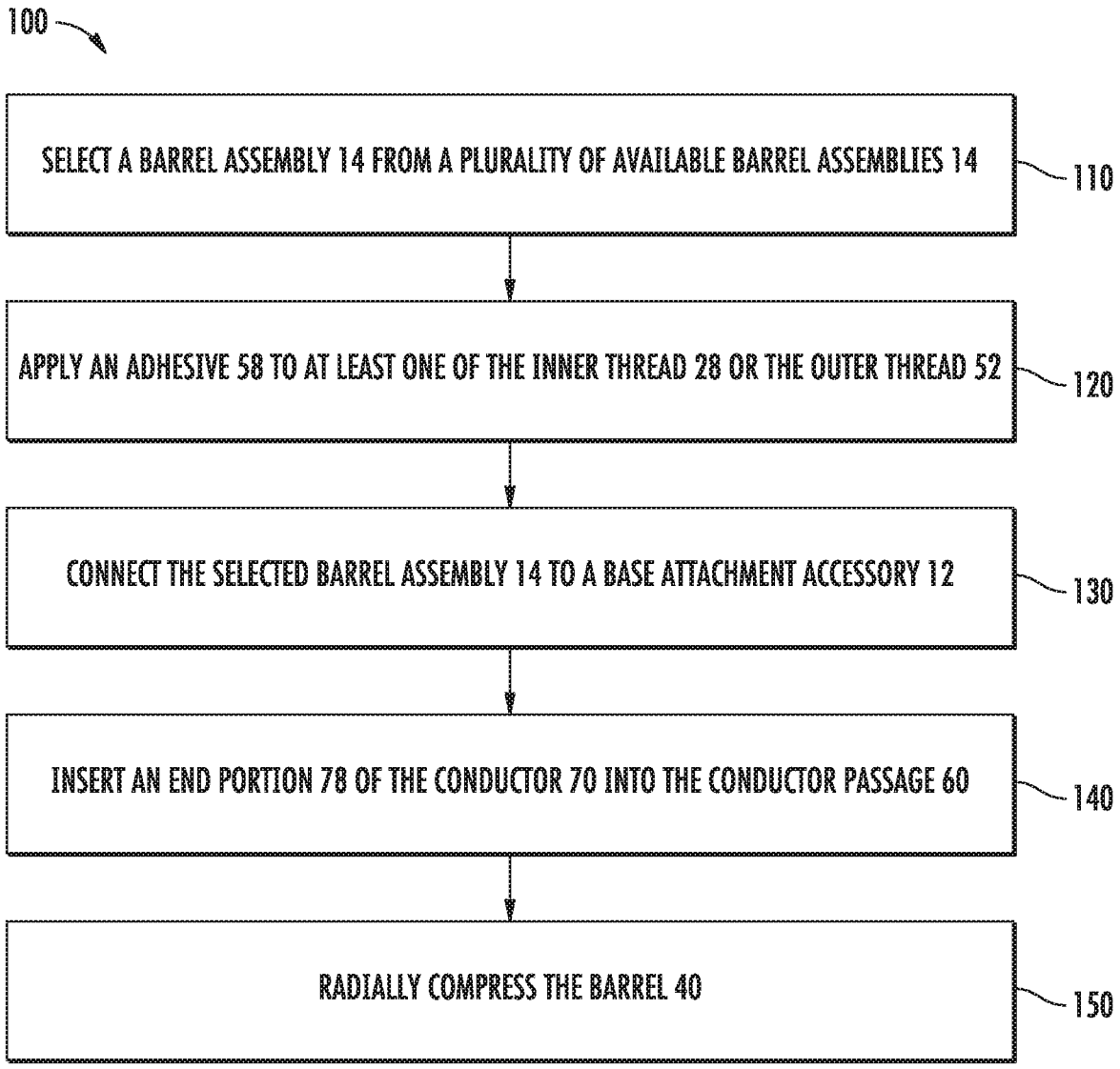
FIG. 8 is a flowchart illustrating a method in accordance with embodiments of the present disclosure.

Referring again to FIGS. 1 through 7 as well as to FIG. 8, the present disclosure is further directed to methods 100 for connecting conductors 70 and conductor connector assemblies 10. A method 100 may include, for example, the step 110 of selecting a barrel assembly 14 from a plurality of barrel assemblies 14, as discussed herein. A method 100 may further include, for example, the step 120 of applying an adhesive 58 to one or both of internal threads 28 and/or external threads 52, as discussed herein. Such step 120 may be performed, in some embodiments, after step 110. A method 100 may further include, for example, the step 130 of connecting the selected barrel assembly 14 to a base attachment accessory 12, as discussed herein. Such step 130 may be performed, in some embodiments, after step 110 and/or step 120. A method 100 may further include, for example, the step 140 of inserting an end portion 78 of a conductor 70 into a conductor passage 60, as discussed herein. Such step 140 may be performed, in some embodiments, after step 110, 120, and/or 130.

Additionally or alternatively, in some embodiments, a method 100 in accordance with the present disclosure may further include, for example, the step of inserting an end portion 78 of a conductor 70 into a tube 120, as discussed herein. In exemplary embodiments, the end portion 68 within the tube 120 may contact a grit coating 66, as discussed herein. Method 100 may further include the step of inserting the tube 120 (and thus in some embodiments the end portion 78) into the conductor passage 60, as discussed herein. Method 100 may further include the step of providing a plurality of lobes 130, such that each lobe 130 is disposed within one of the plurality of passages 110, as discussed herein. Method 100 may further include the step of inserting one or more fasteners 140, each fastener 140 being inserted through one of the plurality of passages 110 and into contact with a tube 120, as discussed herein.

A method 100 may further include, for example, the step 150 of radially compressing the barrel 40, as discussed herein. Such step 150 may be performed, in some embodiments, after step 140 and/or after the various additional steps discussed herein.

Radial compression of the barrel 40 (as, for example, indicated by the arrows in FIG. 3) may serve to mechanically connect the conductor 70 and the conductor connector assembly 10, such as the barrel 40 thereof, together. Such compression of the barrel 40 may be performed by, for example a die press using, for example, a hex die set, a circular die set, a swage die set, or another suitable die set. Alternatively, other suitable compression apparatus may be utilized. Radial compression as discussed herein includes both compression which is entirely radial and compression which has a majority radial component.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A conductor connector assembly, comprising:

a base attachment accessory extending along a longitudinal axis between a first end and a second end, the base attachment accessory further defining a bore hole extending therein from the second end and terminating between the first end and the second end, the base attachment accessory further comprising an internal thread in the bore hole;

a barrel assembly connectable to the base attachment accessory, the barrel assembly comprising a barrel extending between a first end and a second end, the barrel assembly further comprising a rod extending from the first end of the barrel and an external thread on the rod, the external thread mateable with the internal thread, the barrel assembly further defining a conductor passage extending into the barrel from the second end thereof and terminating between the first end and the second end of the barrel, wherein the barrel is radially compressible, wherein the base attachment accessory is a dead end, and wherein the conductor connector assembly is configured to be used in high tension applications.

2. The conductor connector assembly of claim 1, wherein the base attachment assembly is a single, unitary component.

3. The conductor connector assembly of claim 1, wherein the dead end comprises an eye at the first end thereof.

4. The conductor connector assembly of claim 1, wherein the dead end comprises a clevis at the first end thereof.

5. The conductor connector assembly of claim 1, wherein the base attachment accessory is forged.

6. The conductor connector assembly of claim 1, wherein the barrel assembly is formed from steel.

7. The conductor connector assembly of claim 1, wherein an outer diameter of the barrel is greater than an outer diameter of the rod.

8. The conductor connector assembly of claim 1, wherein the barrel has an outer diameter and an axial length, and wherein the barrel assembly is selected from a plurality of available barrel assemblies, each of the plurality of available barrel assemblies having at least one of a different outer diameter or a different axial length from the selected barrel assembly.

9. The conductor connector assembly of claim 1, further comprising an adhesive coating the inner thread and the outer thread.

10. The conductor connector assembly of claim 1, further comprising a conductor comprising an end portion, the end portion comprising an end of the conductor, wherein the end portion is insertable into the conductor passage such that the end is disposed within the conductor passage.

11. The conductor connector assembly of claim 10, wherein the end portion includes a core of the conductor and does not include any outer layers of the conductor.

12. A method for connecting a conductor and a conductor connector assembly, the method comprising:

selecting a barrel assembly from a plurality of available barrel assemblies, the barrel assembly comprising a barrel extending between a first end and a second end, the barrel assembly further comprising a rod extending from the first end of the barrel and an external thread on the rod, the barrel assembly further defining a conductor passage extending into the barrel from the second end thereof and terminating between the first end and the second end of the barrel;

connecting the selected barrel assembly to a base attachment accessory, the base attachment accessory extending along a longitudinal axis between a first end and a second end, the base attachment accessory further defining a bore hole extending therein from the second end and terminating between the first end and the second end, the base attachment accessory further comprising an internal thread in the bore hole, wherein connecting the selected barrel assembly to the base attachment accessory comprises threadably mating the rod into the bore hole, wherein the base attachment accessory is a dead end, and wherein the conductor connector assembly is configured to be used in high tension applications;

inserting an end portion of the conductor into the conductor passage such that an end of the conductor is disposed in the conductor passage; and radially compressing the barrel.

13. The method of claim 12, further comprising applying an adhesive to at least one of the inner thread or the outer thread.

14. The method of claim 12, wherein the conductor is an aluminum conductor steel supported conductor.

15. The method of claim 12, wherein the base attachment assembly is a single, unitary component.

16. The method of claim 12, wherein the dead end comprises an eye at the first end thereof.

17. The method of claim 12, wherein the dead end comprises a clevis at the first end thereof.

18. The method of claim 12, wherein the base attachment accessory is forged.

19. The method of claim 12, wherein the barrel assembly is formed from steel.

20. The method of claim 12, wherein an outer diameter of the barrel is greater than an outer diameter of the rod.

21. The method of claim 12, wherein the barrel has an outer diameter and an axial length, and wherein each of the plurality of available barrel assemblies has at least one of a different outer diameter or a different axial length from the selected barrel assembly.

22. The method of claim 12, wherein the end portion includes a core of the conductor and does not include any outer layers of the conductor.

* * * * *